US009816420B2

(12) United States Patent
Kumar et al.

(10) Patent No.: US 9,816,420 B2
(45) Date of Patent: Nov. 14, 2017

(54) MOUNTING MAT FOR EXHAUST GAS TREATMENT DEVICE

(71) Applicant: Unifrax I LLC, Tonawanda, NY (US)

(72) Inventors: Amit Kumar, Getzville, NY (US); Thomas S. Lacki, Alden, NY (US)

(73) Assignee: Unifrax I LLC, Tonawanda, NY (US)

( * ) Notice: Subject to any disclaimer, the term of this patent is extended or adjusted under 35 U.S.C. 154(b) by 0 days.

(21) Appl. No.: 15/142,529

(22) Filed: Apr. 29, 2016

(65) Prior Publication Data

US 2016/0245143 A1 Aug. 25, 2016

Related U.S. Application Data

(62) Division of application No. 12/968,847, filed on Dec. 15, 2010.

(60) Provisional application No. 61/287,432, filed on Dec. 17, 2009.

(51) Int. Cl.

| | |
|---|---|
| ***D04H 1/46*** | (2012.01) |
| ***F01N 3/28*** | (2006.01) |
| ***D21H 13/36*** | (2006.01) |
| ***D21H 13/38*** | (2006.01) |
| ***D21H 21/14*** | (2006.01) |

(52) U.S. Cl.

CPC ..... *F01N 3/2857* (2013.01); *D21H 13/36* (2013.01); *D21H 13/38* (2013.01); *D21H 21/14* (2013.01); *Y10T 442/689* (2015.04)

(58) Field of Classification Search

CPC ..... F01N 3/2857; D21H 21/14; D21H 13/38; D21H 13/36; Y10T 442/689

See application file for complete search history.

(56) References Cited

U.S. PATENT DOCUMENTS

| | | | |
|---|---|---|---|
| 3,012,923 | A | 12/1961 | Slayter |
| 3,510,394 | A | 5/1970 | Cadotte |
| 3,649,406 | A | 3/1972 | McNish |
| 3,674,621 | A | 7/1972 | Miyamoto et al. |
| 3,771,967 | A | 11/1973 | Nowak |

(Continued)

FOREIGN PATENT DOCUMENTS

| | | |
|---|---|---|
| DE | 3925845 | 2/1991 |
| DE | 196 38 542 | 3/1997 |

(Continued)

OTHER PUBLICATIONS

English language abstract of DE 19858025; Publication Date: Jun. 21, 2000; Applicant: Aslgawo GmbH.

(Continued)

*Primary Examiner* — Elizabeth M Cole

(74) *Attorney, Agent, or Firm* — Curatolo Sidoti Co., LPA; Salvatore A. Sidoti; Daniel E. Moderick

(57) ABSTRACT

A mounting mat for an exhaust gas treatment device includes a wet laid sheet of polycrystalline inorganic fibers that have been physically entangled while the wet laid sheet is still in a wet condition. The exhaust gas treatment device includes a housing, a fragile catalyst support structure resiliently mounted within the housing, and the mounting mat disposed in a gap between the housing and the fragile structure. Additionally disclosed are methods of making a mounting mat for an exhaust gas treatment device and for making an exhaust gas treatment device incorporating the mounting mat.

16 Claims, 2 Drawing Sheets

(56) References Cited

U.S. PATENT DOCUMENTS

| | | | | |
|---|---|---|---|---|
| 3,795,524 | A * | 3/1974 | Sowman | C01B 35/06 423/625 |
| 3,798,006 | A | 3/1974 | Balluff | |
| 3,916,057 | A | 10/1975 | Hatch et al. | |
| 3,957,573 | A | 5/1976 | Miyamoto et al. | |
| 3,996,145 | A | 12/1976 | Hepburn | |
| 4,011,651 | A | 3/1977 | Bradbury et al. | |
| 4,048,363 | A | 9/1977 | Langer et al. | |
| 4,093,423 | A | 6/1978 | Neumann | |
| 4,101,280 | A | 7/1978 | Frietzsche et al. | |
| 4,142,864 | A | 3/1979 | Rosynsky et al. | |
| 4,156,533 | A | 5/1979 | Close et al. | |
| 4,159,205 | A | 6/1979 | Miyahara et al. | |
| 4,204,907 | A | 5/1980 | Korklan et al. | |
| 4,239,733 | A | 12/1980 | Foster et al. | |
| 4,269,807 | A | 5/1981 | Bailey et al. | |
| 4,269,887 | A | 5/1981 | Sonobe et al. | |
| 4,271,228 | A | 6/1981 | Foster et al. | |
| 4,277,269 | A | 7/1981 | Sweeting | |
| 4,279,864 | A | 7/1981 | Nara et al. | |
| 4,305,992 | A | 12/1981 | Langer et al. | |
| 4,328,187 | A | 5/1982 | Musall et al. | |
| 4,332,852 | A | 6/1982 | Korklan et al. | |
| 4,335,077 | A | 6/1982 | Santiago et al. | |
| 4,353,872 | A | 10/1982 | Midorikawa | |
| 4,385,135 | A | 5/1983 | Langer et al. | |
| 4,447,345 | A | 5/1984 | Kummermehr et al. | |
| 4,617,176 | A | 10/1986 | Merry | |
| 4,693,338 | A | 9/1987 | Clerc | |
| 4,746,570 | A | 5/1988 | Suzaki et al. | |
| 4,752,515 | A | 6/1988 | Hosoi et al. | |
| 4,797,263 | A | 1/1989 | Oza | |
| 4,823,845 | A | 4/1989 | Martin et al. | |
| 4,849,382 | A | 7/1989 | Shibata et al. | |
| 4,863,700 | A | 9/1989 | Ten Eyck | |
| 4,865,818 | A | 9/1989 | Merry et al. | |
| 4,927,608 | A | 5/1990 | Wörner et al. | |
| 4,929,429 | A | 5/1990 | Merry | |
| 4,985,212 | A | 1/1991 | Kawakami et al. | |
| 4,999,168 | A | 3/1991 | Ten Eyck | |
| 5,002,836 | A | 3/1991 | Dinwoodie et al. | |
| 5,008,086 | A | 4/1991 | Merry | |
| 5,032,441 | A | 7/1991 | Ten Eyck et al. | |
| 5,073,432 | A | 12/1991 | Horikawa et al. | |
| 5,079,280 | A | 1/1992 | Yang et al. | |
| 5,094,073 | A | 3/1992 | Wörner et al. | |
| 5,094,074 | A | 3/1992 | Nishizawa et al. | |
| 5,119,551 | A | 6/1992 | Abbott | |
| 5,139,615 | A | 8/1992 | Conner et al. | |
| 5,145,811 | A | 9/1992 | Lintz et al. | |
| 5,151,253 | A | 9/1992 | Merry et al. | |
| 5,167,765 | A | 12/1992 | Nielsen et al. | |
| 5,242,871 | A | 9/1993 | Hashimoto et al. | |
| 5,250,269 | A | 10/1993 | Langer | |
| 5,254,410 | A | 10/1993 | Langer et al. | |
| 5,258,216 | A | 11/1993 | Von Bonin et al. | |
| 5,290,522 | A | 3/1994 | Rogers et al. | |
| 5,332,609 | A | 7/1994 | Corn | |
| 5,332,699 | A | 7/1994 | Olds et al. | |
| 5,340,643 | A | 8/1994 | Ou et al. | |
| 5,376,341 | A | 12/1994 | Gulati | |
| 5,380,580 | A | 1/1995 | Rogers et al. | |
| 5,384,188 | A | 1/1995 | Lebold et al. | |
| 5,419,975 | A | 5/1995 | Lintz et al. | |
| 5,453,116 | A | 9/1995 | Fischer et al. | |
| 5,482,686 | A | 1/1996 | Lebold et al. | |
| 5,488,826 | A | 2/1996 | Paas | |
| 5,502,937 | A | 4/1996 | Wilson | |
| 5,523,059 | A | 6/1996 | Langer | |
| 5,567,536 | A | 10/1996 | Lintz et al. | |
| 5,580,532 | A | 12/1996 | Robinson et al. | |
| 5,585,312 | A | 12/1996 | Ten Eyck et al. | |
| 5,666,726 | A | 9/1997 | Robinson et al. | |
| 5,714,421 | A | 2/1998 | Olds et al. | |
| 5,736,109 | A | 4/1998 | Howorth et al. | |
| 5,811,063 | A | 9/1998 | Robinson et al. | |
| 5,811,360 | A | 9/1998 | Jubb | |
| 5,821,183 | A | 10/1998 | Jubb | |
| 5,853,675 | A | 12/1998 | Howorth | |
| 5,862,590 | A | 1/1999 | Sakashita et al. | |
| 5,869,010 | A | 2/1999 | Langer | |
| 5,874,375 | A | 2/1999 | Zoitos et al. | |
| 5,882,608 | A | 3/1999 | Sanocki et al. | |
| 5,928,075 | A | 7/1999 | Miya et al. | |
| 5,928,975 | A | 7/1999 | Jubb | |
| 5,955,389 | A | 9/1999 | Jubb | |
| 6,000,131 | A | 12/1999 | Schmitt | |
| 6,025,288 | A | 2/2000 | Zoitos et al. | |
| 6,030,910 | A | 2/2000 | Zoitos et al. | |
| 6,051,193 | A | 4/2000 | Langer et al. | |
| 6,101,714 | A | 8/2000 | Schmitt | |
| 6,158,120 | A | 12/2000 | Foster et al. | |
| 6,162,404 | A | 12/2000 | Tojo et al. | |
| 6,231,818 | B1 | 5/2001 | Ten Eyck | |
| 6,251,224 | B1 | 6/2001 | Dong | |
| 6,267,843 | B1 | 7/2001 | Helwig et al. | |
| 6,317,976 | B1 | 11/2001 | Aranda et al. | |
| 6,468,932 | B1 | 10/2002 | Robin et al. | |
| 6,589,488 | B1 | 7/2003 | Eyhorn | |
| 6,726,884 | B1 | 4/2004 | Dillon et al. | |
| 6,733,628 | B2 | 5/2004 | Dinwoodie et al. | |
| 6,737,146 | B2 | 5/2004 | Schierz et al. | |
| 6,756,107 | B1 | 6/2004 | Schierz et al. | |
| 6,855,298 | B2 | 2/2005 | TenEyck | |
| 6,861,381 | B1 | 3/2005 | Jubb et al. | |
| 6,923,942 | B1 | 8/2005 | Shirk et al. | |
| 6,953,757 | B2 | 10/2005 | Zoitos et al. | |
| 7,033,412 | B2 | 4/2006 | Kumar et al. | |
| 7,153,796 | B2 | 12/2006 | Jubb et al. | |
| 7,160,503 | B2 | 1/2007 | Weaver | |
| 7,259,118 | B2 | 8/2007 | Jubb et al. | |
| 7,261,864 | B2 | 8/2007 | Watanabe | |
| 7,276,280 | B2 | 10/2007 | Dinwoodie et al. | |
| 7,387,822 | B2 | 6/2008 | Dinwoodie | |
| 7,550,118 | B2 | 6/2009 | Merry | |
| 7,820,117 | B2 | 10/2010 | Peisert et al. | |
| 7,887,917 | B2 | 2/2011 | Zoitos et al. | |
| 7,971,357 | B2 | 7/2011 | Ten Eyck et al. | |
| 8,404,187 | B1 | 3/2013 | Fernando et al. | |
| 2001/0036427 | A1 | 11/2001 | Yamada et al. | |
| 2002/0025750 | A1 | 2/2002 | Dinwoodie | |
| 2002/0025904 | A1 | 2/2002 | Goto et al. | |
| 2002/0127154 | A1 | 9/2002 | Foster et al. | |
| 2003/0049180 | A1 | 3/2003 | Fukushima | |
| 2003/0056861 | A1 | 3/2003 | Weaver | |
| 2003/0185724 | A1 | 10/2003 | Anji et al. | |
| 2004/0052694 | A1 | 3/2004 | Nishikawa et al. | |
| 2004/0234436 | A1 | 11/2004 | Howorth | |
| 2005/0272602 | A1 | 12/2005 | Ninomiya | |
| 2006/0153746 | A1 | 7/2006 | Merry et al. | |
| 2006/0154040 | A1 | 7/2006 | Merry | |
| 2006/0278323 | A1 | 12/2006 | Eguchi | |
| 2007/0065349 | A1 | 3/2007 | Merry | |
| 2007/0207069 | A1 | 9/2007 | Kariya et al. | |
| 2007/0218320 | A1 | 9/2007 | Weaver | |
| 2008/0253939 | A1 | 10/2008 | Hornback | |
| 2009/0060800 | A1 | 3/2009 | Fernandez, Jr. | |
| 2009/0060802 | A1 | 3/2009 | Beauharnois | |
| 2009/0114097 | A1 | 5/2009 | Saiki | |
| 2009/0162256 | A1 | 6/2009 | Ten Eyck et al. | |
| 2010/0055004 | A1 | 3/2010 | Olson et al. | |
| 2010/0207298 | A1 | 8/2010 | Kunze et al. | |
| 2010/0209306 | A1 | 8/2010 | Kunze et al. | |
| 2011/0094419 | A1 | 4/2011 | Fernando et al. | |
| 2012/0100046 | A1 | 4/2012 | Kelsall et al. | |

FOREIGN PATENT DOCUMENTS

| | | | |
|---|---|---|---|
| DE | 199 57 692 | 5/2001 | |
| DE | WO 2006065534 A1 * | 6/2006 | A61M 5/007 |
| EP | 0 205 704 | 12/1986 | |
| EP | 0 279 511 | 8/1988 | |
| EP | 0 319 299 | 6/1989 | |
| EP | 0 328 293 | 8/1989 | |

(56) References Cited

FOREIGN PATENT DOCUMENTS

| | | |
|---|---|---|
| EP | 0 396 331 | 11/1990 |
| EP | 0 398 130 | 11/1990 |
| EP | 0465 203 | 1/1992 |
| EP | 0 508 751 | 10/1992 |
| EP | 0 551 532 | 7/1993 |
| EP | 0 573 834 | 12/1993 |
| EP | 0 643 204 | 3/1995 |
| EP | 0 765 993 | 4/1997 |
| EP | 0 803 643 | 10/1997 |
| EP | 1 267 048 | 12/2002 |
| EP | 1336678 | 10/2004 |
| EP | 1 495 807 | 1/2005 |
| EP | 1 533 409 | 5/2005 |
| EP | 1 696 110 | 8/2006 |
| EP | 1 905 895 | 6/2007 |
| EP | 1 830 043 | 9/2007 |
| EP | 1 931 862 | 6/2008 |
| EP | 1 950 035 | 7/2008 |
| GB | 1 438 762 | 6/1976 |
| GB | 1 438 784 | 6/1976 |
| GB | 1 513 808 | 6/1978 |
| GB | 2 116 476 | 9/1983 |
| GB | 2 125 458 | 3/1984 |
| GB | 2 200 129 | 7/1988 |
| GB | 2 319 247 | 5/1998 |
| JP | 4-83773 A | 3/1992 |
| JP | H0441757 | 12/1992 |
| JP | 6-272549 | 9/1994 |
| JP | 7-286514 | 10/1995 |
| JP | 2006/177368 | 7/2006 |
| JP | 2008/038276 | 2/2008 |
| WO | WO 91/11498 | 8/1991 |
| WO | WO 93/23245 | 11/1993 |
| WO | WO 94/24425 | 10/1994 |
| WO | WO 97/02413 | 1/1997 |
| WO | WO 97/32118 | 9/1997 |
| WO | WO 98/04404 | 2/1998 |
| WO | WO 99/23370 | 5/1999 |
| WO | WO 99/46028 | 9/1999 |
| WO | WO 00/75496 | 4/2000 |
| WO | WO 01/65008 | 9/2001 |
| WO | WO 01/83956 | 11/2001 |
| WO | WO 02/33233 | 4/2002 |
| WO | WO 02/053511 | 7/2002 |
| WO | WO 03/000414 | 1/2003 |
| WO | WO 03/031368 | 4/2003 |
| WO | WO 2004/031544 | 4/2004 |
| WO | WO 2005/106222 | 11/2005 |
| WO | WO 2006/065534 | 6/2006 |
| WO | WO 2007/054697 | 5/2007 |
| WO | WO 2007/143437 | 12/2007 |
| WO | WO 2008/059249 | 5/2008 |
| WO | WO 2008/103525 | 8/2008 |
| WO | WO 2008/154078 | 12/2008 |
| WO | WO 2008/156942 | 12/2008 |
| WO | WO 2009/032191 | 3/2009 |
| WO | WO 2011/067598 | 6/2011 |

OTHER PUBLICATIONS

Tosa Shin'ichi, et al., "The Development of Converter Canning Technology for Thin Wall Substrate." Honda R&D Tech. Rev., vol. 12, No. 1, pp. 175-182, Japan (2000).

Gulati, Ten Eyck & Lebold. "Durable Packaging Design for Cordierite Ceramic Catalysts for Motorcycle Application" Society of Automotive Engineers Meeting, Detroit, MI, Mar. 1, 1993.

Maret, Gulati, Lambert & Zink. Systems Durability of a Ceramic Racetrack Converter. International Fuels and Lubricants Meeting, Toronto, Canada, Oct. 7-10, 1991.

International Search Report, Form PCT/ISA/201 mailed Mar. 30, 2011 for PCT International Patent Application No. PCT/US2010/060493.

Written Opinion, Form PCT/ISA/237 mailed Mar. 30, 2011 for PCT International Patent Application No. PCT/US2010/060493.

International Preliminary Report on Patentability, Form PCT/IB/373 for PCT International Patent Application No. PCT/US2010/060516, Mailing Date Jun. 28, 2012.

International Search Report and Written Opinion for PCT International Patent Application No. PCT/US2010/060516, mailed Mar. 14, 2011.

Monotonic and Cyclic Fatigue Behavior of High-Performance Ceramic Fibers, Chawla et al, Journal of the American Ceramic Society, vol. 88, pp. 101-108, 2005.

English language translation of Office Action for Japanese Patent Application No. 2012-544756; dated Jan. 5, 2015.

English language translation of Office Action for Japanese Patent Application No. 2012-544756; dated Nov. 26, 2015.

English language translation of Office Action for Japanese Patent Application No. 2012-544756; dated Nov. 19, 2016.

* cited by examiner

MOUNTING MAT FOR EXHAUST GAS TREATMENT DEVICE

CROSS REFERENCE TO RELATED APPLICATIONS

This application is a divisional application of U.S. Ser. No. 12/968,847, filed on Dec. 15, 2010, which claims the benefit of the filing date under 35 U.S.C. 119(e) from U.S. Provisional Application Patent Ser. No. 61/287,432 filed on Dec. 16, 2009, which is incorporated herein by reference.

TECHNICAL FIELD

The disclosure relates to a wet laid and physically entangled mounting mat for an exhaust gas treatment device, such as a catalytic converter or a diesel particulate trap. The exhaust gas treatment device may include a fragile structure that is mounted within a housing by the mounting mat that is disposed in a gap between the housing and the catalyst support structure.

BACKGROUND

Exhaust gas treatment devices are used on automobiles to reduce atmospheric pollution from engine emissions. Examples of widely used exhaust gas treatment devices include catalytic converters and diesel particulate traps.

A catalytic converter for treating exhaust gases generated an automotive engine includes a housing, a fragile catalyst support structure for holding the catalyst that is used to effect the oxidation of carbon monoxide and hydrocarbons and the reduction of oxides of nitrogen, and a mounting mat disposed between the outer surface of the fragile catalyst support structure and the inner surface of the housing to hold the fragile catalyst support structure within the housing.

A diesel particulate trap for controlling pollution generated by diesel engines generally includes a housing, a fragile particulate filter or trap for collecting particulate from the diesel engine emissions, and a mounting mat that is disposed between the outer surface of the filter or trap and the inner surface of the housing to hold the fragile filter or trap structure within the housing.

The fragile structure generally comprises a monolithic structure manufactured from a frangible material of metal or a brittle, ceramic material such as aluminum oxide, silicon dioxide, magnesium oxide, zirconia, cordierite, silicon carbide and the like. These materials provide a skeleton type of structure with a plurality of gas flow channels. These monolithic structures can be so fragile that even small shock loads or stresses are often sufficient to crack or crush them. In order to protect the fragile structure from thermal and mechanical shock and other stresses, as well as to provide thermal insulation and a gas seal, a mounting mat is positioned within the gap between the fragile structure and the housing.

Polycrystalline wool mats may be produced by either a dry laid or wet laid process. Before the drying and calcining stages in the production of polycrystalline wool mats, the sol-gel fibers are flexible. Needling equipment is used at this stage to mechanically interlock the sol-gel fibers while they remain flexible. Following the needling stage, the needled polycrystalline wool mat is dried and calcined. The calcining process renders the sol-gel fibers stiffer.

While the sol-gel fibers remain flexible prior to the drying and calcining stages of the polycrystalline wool mat processing, the sol-gel fibers contain greater than 5 percent water and therefore they are sensitive to exposure to water. Consequently, prior to the drying stage, upon exposure to water used during a wet laid process, the sol-gel fibers would degrade and dissolve. Because of the water sensitivity, only dried and calcined sol-gel fibers are used in a wet laid mat forming process. As only dried and calcined sol-gel fibers are used in the wet laid mat forming process, there is no possibility of needling since any attempt to needle the brittle and stiff sol-gel fibers would result in breaking of the fibers and resulting in a mat with extremely low tensile strength.

DETAILED DESCRIPTION

Figure 1:
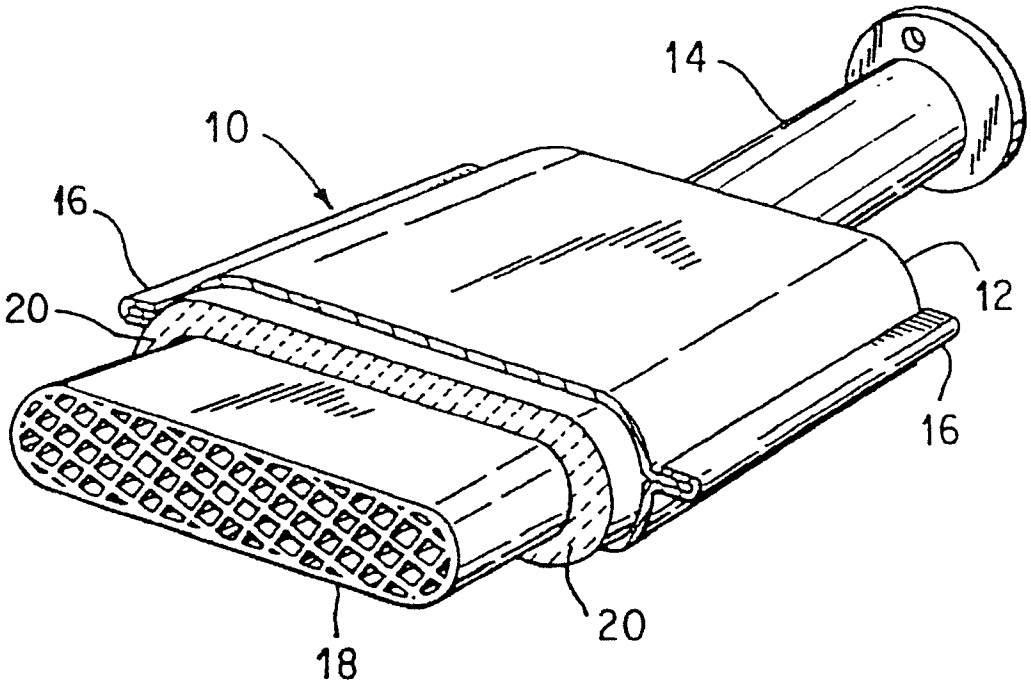
FIG. 1 is a perspective view of an illustrative exhaust gas treatment including presently disclosed mounting mat.

Provided is a mounting mat useful in an exhaust gas treatment device. The mounting mat comprising a plurality of sol-gel inorganic fibers that have been wet laid into a sheet and physically entangled. The mat of wet-laid and physically entangled sol-gel derived fibers may be used as a mounting mat to mount a fragile catalysts support structure within an outer housing or as a thermal insulation mat in the end cone regions of the exhaust gas treatment device.

According to certain illustrative embodiments, the mounting mat for an exhaust gas treatment device comprises a plurality of sol-gel inorganic fibers that have been wet laid into a sheet and the sheet needled while it is still in a wet condition. That is, the needling operation is performed on the wet laid layer while still wet. The mat of wet-laid and needled sol-gel derived fibers may be used as a mounting mat to mount a fragile catalysts support structure within an outer housing or as a thermal insulation mat in the end cone regions of the exhaust gas treatment device.

The mounting mat comprises at least one layer of sol-gel derived fibers that have been wet laid and physically entangled. The method for making the mounting mat for an exhaust gas treatment device comprises providing sol-gel derived inorganic fibers, stabilizing the sol-gel fibers, wet forming a layer of the stabilized sol-gel derived fibers, physically entangling the stabilized layer of sol-gel derived fibers, and calcining the physically entangled layer of sol-gel derived fibers.

According to certain illustrative embodiments, the mounting mat comprises at least one layer of sol-gel derived fibers that have been wet laid and needled. The method for making the mounting mat for an exhaust gas treatment device comprises providing sol-gel derived inorganic fibers, stabilizing the sol-gel fibers, wet forming a layer of the stabilized sol-gel derived fibers, needling the stabilized layer of sol-gel derived fibers, and calcining the needled layer of sol-gel derived fibers. The layer of sol-gel derived inorganic fibers may be prepared by forming a slurry of a plurality of the sol-gel derived inorganic fibers, suitable processing agents, and a suitable liquid, such as water. The layer of sol-gel derived fibers is formed by removing at least a portion of the liquid from the slurry. This process is referred to in the art as "wet-laying" and the resulting layer of sol-gel derived inorganic fibers is referred to as a "wet-laid" layer.

The sol-gel derived inorganic fibers present in the wet-laid layer are flexible enough to withstand typical mechanical needling processes. However, the sol-gel derived fibers are also sensitive to water and dissolve upon contact with water. The sol-gel derived fibers are treated to stabilize the fibers against dissolution in water. The step of treating to stabilize the sol-gel derived fibers against dissolution may comprise heating the sol-gel derived fibers in the layer at a temperature sufficient to render at least a portion of the sol-gel derived fibers insoluble in water. Without limitation, and only by way of illustration, the layer of sol-gel derived fibers may be heated at a temperature of 700° C. or lower. According to other embodiments, the layer of sol-gel derived fibers may be heated at a temperature of 600° C. or lower. Heating the sol-gel derived fibers at a suitable temperature, such as at a temperature of 700° C. or lower, render the sol-gel fibers substantially resistant to dissolution or other degradation upon exposure to water. After heating the sol-gel derived fibers at a temperature of 700° C. or lower the fibers do not become brittle or stiff and still retain sufficient flexibility to survive a needling operation. While the sol-gel fibers may be heated as described above to stabilize against dissolution, any method that improves the dissolution resistance of the sol-gel fibers may be utilized.

After the sol-gel derived fibers have been stabilized, for example, by heat treating the sol-gel derived fibers, a wet-laid layer of stabilized fibers is formed and the layer undergoes a mechanical needling process. The needling process changes the orientation of at least a portion of the fibers within the layer and mechanically interlocks these fibers within the layer.

In one embodiment of the process for making the subject mounting mat, a ply or layer comprising the high temperature resistant fibers, optionally organic binder and optionally intumescent material, is wet-laid on a rotoformer, and multiple plies or layers of the still wet paper or sheet are stacked and processed through a "needler", prior to being fed through a drying oven. This process includes needle punching the fibers so as to intertwine and entangle a portion of them, while still wet with the aqueous paper-making solution or slurry, prior to drying the sheet. The resulting mounting mat is therefore strengthened as compared to prior art mounting mats of similar thickness and density.

In typical fiber needling operations (usually immediately after the fiberizing step), a lubricating liquid (normally an oil or other lubricating organic material) is used to prevent fiber breakage and to aid in fiber movement and entanglement. In the present process, it is the water from the wet-forming, paper-making process is used to aid the process of needling.

By needling, it is meant any operation that will cause a portion of fibers to be displaced from their orientation within the paper or sheet, and extend for some length between the opposing surfaces of the paper or sheet. A needling apparatus typically includes a horizontal surface on which a web of fibers is laid or moves, and a needle board which carries an array of downwardly extending needles. The needle board reciprocates the needles into, and out of, the web, and reorients some of the fibers of the web into planes substantially transverse to the surfaces of the web. The needles can push fibers through the web from one direction, or for example, by use of barbs on the needles, can both push fibers from the top and pull fibers from the bottom of the web. There is typically provided physical entanglement of the fibers by full or partial penetration of the fiber paper or sheet by the barbed needles.

Additionally or alternatively, hydroentangling methods (also known as water-jet needling or fluid-jet needling) may be used to intertwine and entangle the fibers. In a hydroentanglement process, small, high intensity jets of water are impinged on a layer or sheet of loose fibers, with the fibers being supported on a perforated surface, such as a wire screen or perforated drum. The liquid jets cause the fibers, being relatively short and having loose ends, to become rearranged, with at least some portions of the fibers becoming physically entangled, wrapped, and/or intertwined around each other.

After the needling or hydro-entangling of the still wet paper or vacuum-cast mat, the mat may optionally be pressed, and is dried in an oven, for example but not limitation, at about 80° C. to about 700° C.

The wet needling step allows even brittle fiber to be woven without significant breakage. The wet needling further provides high strength, even after the organic binder has been burned out, such as in the initial operation of the vehicle, which results in the mat remaining durable even under vibration conditions experienced by an automotive exhaust system.

Figure 2:
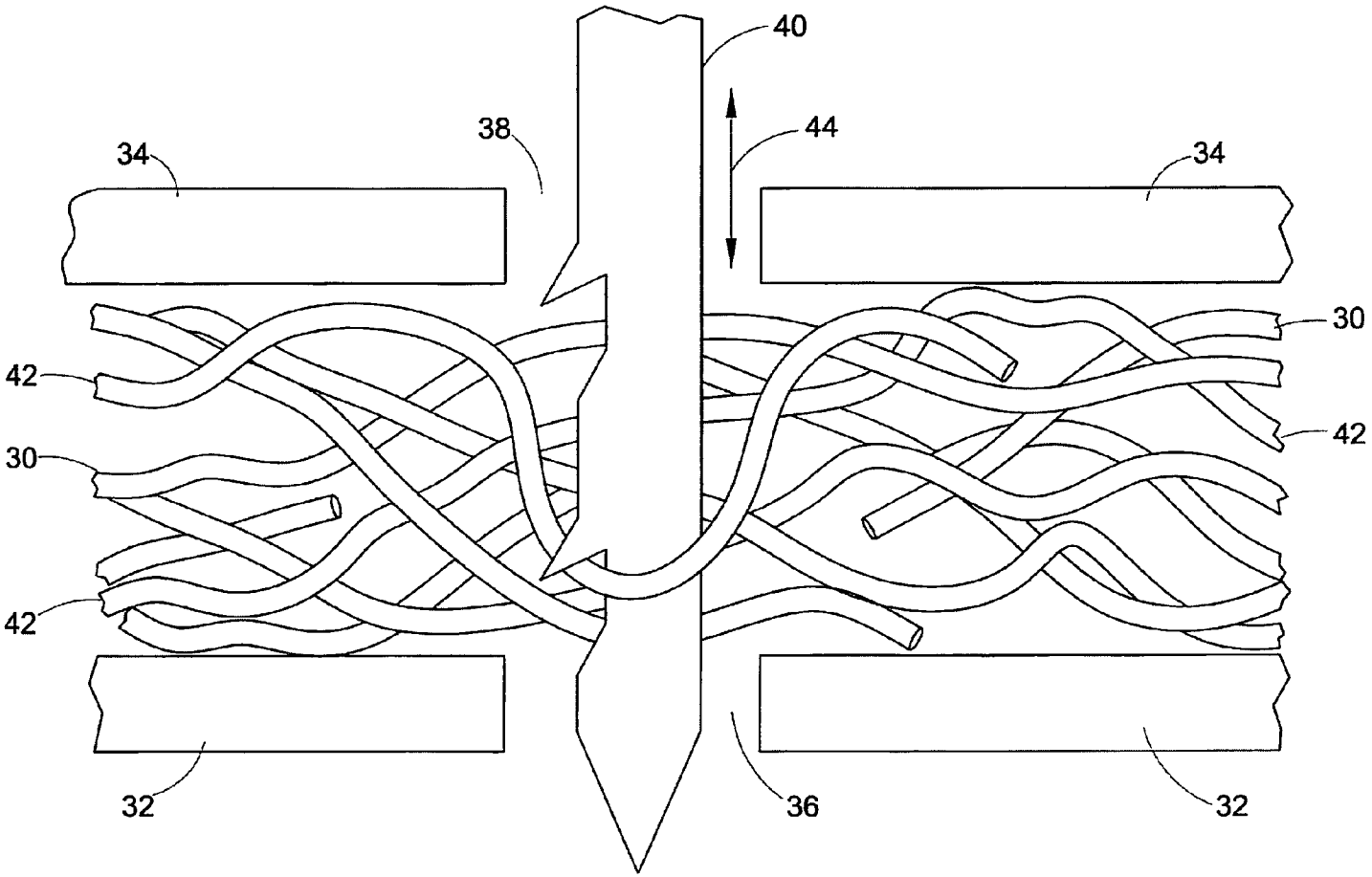
FIG. 2 is schematic of a portion of a suitable needling machine for needling the fibrous mounting mat.

As shown in FIG. 2, needling includes passing the formed paper 30 in a still wet condition between a bed plate 32 and a stripper plate 34, which both have apertures 36, 38 to permit barbed needles 40 to pass therethrough in a reciprocating manner, as indicated by arrow 44. The needles 40 push and pull fibers 42 in the paper 30 to induce an entangling three dimensional interlocking orientation to the fibers 42, strengthening the paper 30 which is subsequently dried in an oven.

The wet-laid and needled layer of sol-gel derived fibers is calcined to provide the final mat product for end cone insulation or mounting mat in an exhaust gas treatment device. According to certain embodiments, the calcining of the wet-laid and needled layer of sol-gel derived fibers may occur at a temperature in the range from about 900 to about 1,500° C.

The exhaust gas treatment device includes an outer housing, a fragile catalyst support structure, and a mounting mat wherein of at least one layer of wet laid and physically entangled inorganic sol-gel derived fibers that is disposed in the gap between the inner surfaces of the outer housing and the outer surface of the fragile catalyst support structure. The wet-laid and needled mounting mat is used to resiliently mount the fragile catalyst support structure within the housing and to protect the catalyst support structure from both mechanical and thermal shock encountered during operation of the exhaust gas treatment device.

According to certain illustrative embodiments, the exhaust gas treatment device includes an outer housing, a fragile catalyst support structure, and a mounting mat wherein of at least one layer of wet laid and needle inorganic sol-gel derived fibers that is disposed in the gap between the inner surfaces of the outer housing and the outer surface of the fragile catalyst support structure. The wet-laid and needled mounting mat is used to resiliently mount the fragile catalyst support structure within the housing and to protect the catalyst support structure from both mechanical and thermal shock encountered during operation of the exhaust gas treatment device.

Catalyst structures generally include one or more porous tubular or honeycomb-like structures mounted by a thermally resistant material within a housing. Each structure includes anywhere from about 200 to about 900 or more channels or cells per square inch, depending upon the type of exhaust treating device. A diesel particulate trap differs from a catalyst structure in that each channel or cell within the particulate trap is closed at one end or the other. Particulate is collected from exhaust gases in the porous structure until regenerated by a high temperature burnout process. Non-automotive applications for the mounting mat may include catalytic converters for chemical industry emission (exhaust) stacks.

One illustrative form of a device for treating exhaust gases is designated by the numeral 10 in FIG. 1. It should be understood that the mounting mat is not intended to be limited to use in the device shown in FIG. 1, and so the shape is shown only as an illustrative embodiment. In fact, the mounting mat could be used to mount or support any fragile structure suitable for treating exhaust gases, such as a diesel catalyst structure, a diesel particulate trap, or the like.

Catalytic converter 10 may include a generally tubular housing 12 formed of two pieces of metal, for example, high temperature resistant steel, held together by flange 16. Alternatively, the housing may include a preformed canister into which a mounting mat-wrapped fragile structure is inserted. Housing 12 includes an inlet 14 at one end and an outlet (not shown) at its opposite end. The inlet 14 and outlet are suitable formed at their outer ends whereby they may be secured to conduits in the exhaust system of an internal combustion engine. Device 10 contains a fragile structure, such as a frangible ceramic monolith 18, which is supported and restrained within housing 12 by a mounting mat 20. Monolith 18 includes a plurality of gas pervious passages that extend axially from its inlet end surface at one end to its outlet end surface at its opposite end. Monolith 18 may be constructed of any suitable refractory metal or ceramic material in any known manner and configuration. Monoliths are typically oval or round in cross-sectional configuration, but other shapes are possible.

The monolith is spaced from inner surfaces of the housing by a distance or a gap, which will vary according to the type and design of the device utilized, for example, a catalytic converter, a diesel catalyst structure, or a diesel particulate trap. This gap is filled with a mounting mat 20 to provide resilient support to the ceramic monolith 18. The resilient mounting mat 20 provides both thermal insulation to the external environment and mechanical support to the fragile structure, thereby protecting the fragile structure from mechanical shock across a wide range of exhaust gas treatment device operating temperatures.

In general, the mounting mat includes sol-gel derived polycrystalline inorganic fibers, and optionally at least one of intumescent material, organic binder, clay, and an antioxidant. The composition of the mounting mat 20 is sufficient to provide a holding pressure capability to resiliently hold the fragile catalyst support structure 18 within a housing 12 of an exhaust gas treatment device 10 throughout a wide temperature range.

The wet-laid and needled layer of sol-gel derived fibers may also be used as a thermal insulation mat in the end cones of the exhaust gas treatment device. The end cone for an exhaust gas treatment device includes outer metallic cone, an inner metallic cone, and a layer of cone insulation comprising one layer of wet-laid and needled inorganic sol-gel derived fibers positioned between the outer and inner metallic end cones.

Sol-gel derived inorganic fibers which are useful in the present mat include polycrystalline oxide fibers such as mullites, alumina, high alumina aluminosilicates, and the like. The fibers are preferably refractory. Suitable sol-gel polycrystalline oxide fibers and methods for producing the same are contained in U.S. Pat. Nos. 4,159,205 and 4,277,269, which are incorporated herein by reference. FIBERMAX polycrystalline mullites fibers are available from Unifrax I LLC, Niagara Falls, N.Y. A further suitable polycrystalline mullite fiber for use in the manufacture of the present mounting mat is commercially available from Mitsubishi Chemical Corporation under the trademark MAFTEC. Suitable sol-gel derived polycrystalline fibers include alumina fibers, such as fibers comprising at least 60 weight percent alumina. According to certain illustrative embodiments, the alumina fibers may comprise high alumina-containing fibers. For example, and without limitation, suitable high alumina-containing fibers are commercially available from Saffil Ltd. (Cheshire, United Kingdom). The high alumina-containing fibers from Saffil Ltd. comprise from about 95 to about 97 weight percent alumina and from about 3 to about 5 weight percent silica.

The wet-laid and needled layer of sol-gel derived fibers may also include a minor amount of a different class of inorganic fibers so long as the fibers can withstand the mounting mat forming process, can withstand the operating temperatures of the exhaust gas treatment devices, and provide the minimum holding pressure performance for holding fragile structure within the exhaust gas treatment device housing at the operating temperatures. Without limitation, the mounting mat may include further types of suitable inorganic fibers such as refractory ceramic fibers such as alumino-silicate fibers, alumina-magnesia-silica fibers, kaolin fibers, alkaline earth silicate fibers such as calcia-magnesia-silica fibers and magnesia-silica fibers, calcium-aluminate fibers, phosphate coated calcium-aluminate fibers, potassium-calcium-aluminate fibers, potassium-alumino-siliate fibers, sodia-alumina-silicate fibers, S-glass fibers, S2-glass fibers, E-glass fibers, quartz fibers, silica fibers and combinations thereof.

According to certain embodiments, the heat resistant inorganic fibers may include ceramic fibers. Without limitation, suitable ceramic fibers include alumina-silica fibers, alumina-zirconia-silica fibers, zirconia-silica fibers, zirconia fibers and similar fibers. A useful alumina-silica ceramic fiber is commercially available from Unifrax I LLC (Niagara Falls, N.Y.) under the registered trademark FIBERFRAX. The FIBERFRAX ceramic fibers comprise the fiberization product of about 45 to about 75 weight percent alumina and about 25 to about 55 weight percent silica. The FIBERFRAX fibers exhibit operating temperatures of up to about 1540° C. and a melting point up to about 1870° C. The FIBERFRAX fibers easily formed into high temperature resistant sheets and papers.

The alumina silica fiber may comprise from about 40 weight percent to about 60 weight percent $Al_2O_3$ and about 60 weight percent to about 40 weight percent $SiO_2$. The fiber may comprise about 50 weight percent $Al_2O_3$ and about 50 weight percent $SiO_2$. The alumina/silica magnesia glass fiber typically comprises from about 64 weight percent to about 66 weight percent $SiO_2$, from about 24 weight percent to about 25 weight percent $Al_2O_3$, and from about 9 weight percent to about 10 weight percent MgO.

The E-glass fiber typically comprises from about 52 weight percent to about 56 weight percent $SiO_2$, from about 16 weight percent to about 25 weight percent CaO, from about 12 weight percent to about 16 weight percent $Al_2O_3$, from about 5 weight percent to about 10 weight percent $B_2O_3$, up to about 5 weight percent MgO, up to about 2 weight percent of sodium oxide and potassium oxide and trace amounts of iron oxide and fluorides, with a typical composition of 55 weight percent $SiO_2$, 15 weigh percent $Al_2O_3$, 7 weight percent $B_2O_3$, 3 weight percent MgO, 19 weight percent CaO and traces of the above mentioned materials.

Without limitation, suitable examples of biosoluble alkaline earth silicate fibers that can be used to prepare a mounting mat for an exhaust gas treatment device include those fibers disclosed in U.S. Pat. Nos. 6,953,757, 6,030,910, 6,025,288, 5,874,375, 5,585,312, 5,332,699, 5,714,421, 7,259,118, 7,153,796, 6,861,381, 5,955,389, 5,928,075, 5,821,183, and 5,811,360, which are incorporated herein by reference.

According to certain embodiments, the biosoluble alkaline earth silicate fibers may comprise the fiberization product of a mixture of oxides of magnesium and silica. These fibers are commonly referred to as magnesium-silicate fibers. The magnesium-silicate fibers generally comprise the fiberization product of about 60 to about 90 weight percent silica, from greater than 0 to about 35 weight percent magnesia and 5 weight percent or less impurities. According to certain embodiments, the alkaline earth silicate fibers comprise the fiberization product of about 65 to about 86 weight percent silica, about 14 to about 35 weight percent magnesia and 5 weight percent or less impurities. According to other embodiments, the alkaline earth silicate fibers comprise the fiberization product of about 70 to about 86 weight percent silica, about 14 to about 30 weight percent magnesia, and 5 weight percent or less impurities. A suitable magnesium-silicate fiber is commercially available from Unifrax I LLC (Niagara Falls, N.Y.) under the registered trademark ISOFRAX. Commercially available ISOFRAX fibers generally comprise the fiberization product of about 70 to about 80 weight percent silica, about 18 to about 27 weight percent magnesia and 4 weight percent or less impurities.

According to certain embodiments, the biosoluble alkaline earth silicate fibers may comprise the fiberization product of a mixture of oxides of calcium, magnesium and silica. These fibers are commonly referred to as calcia-magnesia-silica fibers. According to certain embodiments, the calcia-magnesia-silicate fibers comprise the fiberization product of about 45 to about 90 weight percent silica, from greater than 0 to about 45 weight percent calcia, from greater than 0 to about 35 weight percent magnesia, and 10 weight percent or less impurities. Useful calcia-magnesia-silicate fibers are commercially available from Unifrax I LLC (Niagara Falls, N.Y.) under the registered trademark INSULFRAX. INSULFRAX fibers generally comprise the fiberization product of about 61 to about 67 weight percent silica, from about 27 to about 33 weight percent calcia, and from about 2 to about 7 weight percent magnesia. Other suitable calcia-magnesia-silicate fibers are commercially available from Thermal Ceramics (Augusta, Ga.) under the trade designations SUPER WOOL 607, SUPERWOOL 607 MAX and SUPERWOOL HT. SUPERWOOL 607 fibers comprise about 60 to about 70 weight percent silica, from about 25 to about 35 weight percent calcia, and from about 4 to about 7 weight percent magnesia, and trace amounts of alumina. SUPERWOOL 607 MAX fibers comprise about 60 to about 70 weight percent silica, from about 16 to about 22 weight percent calcia, and from about 12 to about 19 weight percent magnesia, and trace amounts of alumina. SUPERWOOL HT fiber comprise about 74 weight percent silica, about 24 weight percent calcia and trace amounts of magnesia, alumina and iron oxide.

Suitable silica fibers use in the production of a mounting mat for an exhaust gas treatment device include those leached glass fibers available from Belchem Fiber Materials GmbH. Germany, under the trademark BELCOTEX, from Hitco Carbon Composites. Inc. of Gardena Calif., under the registered trademark REFRASIL, and from Polotsk-Steklovolokno, Republic of Belarus, under the designation PS-23(R).

The BELCOTEX fibers are standard type, staple fiber pre-yarns. These fibers have an average fineness of about 550 tex and are generally made from silicic acid modified by alumina. The BELCOTEX fibers are amorphous and generally contain about 94.5 silica, about 4.5 percent alumina, less than 0.5 percent sodium oxide, and less than 0.5 percent of other components. These fibers have an average fiber diameter of about 9 microns and a melting point in the range of 1500 to 1550° C. These fibers are heal resistant to temperatures of up to 1100° C. and are typically shot free and binder free.

The REFRASIL fibers, like the BELCOTEX fibers, are amorphous leached glass fibers high in silica content for providing thermal insulation for applications in the 1000 to 1100° C. temperature range. These fibers are between about 6 and about 13 microns in diameter, and have a melting point of about 1700° C. The fibers, after leaching, typically have a silica content of about 95 percent by weight. Alumina may be present in an amount of about 4 percent by weight with other components being present in an amount of 1 percent or less.

The PS-23 (R) fibers from Polotsk-Steklovolokno are amorphous glass fibers high in silica content and are suitable for thermal insulation for applications requiring resistance to at least about 1000° C. These fibers have a fiber length in the range of about 5 to about 20 mm and a fiber diameter of about 9 microns. These fibers, like the REFRASIL fibers, have a melting point of about 1700° C.

The layer of wet-laid and needled sol-gel derived fibers may also include an intumescent material. The intumescent material that may be incorporated into the mounting mat includes, without limitation, unexpanded vermiculite, ion-exchanged vermiculite, heat treated vermiculite, expandable graphite, hydrobiotite, water-swelling tetrasilicic flourine mica, alkaline metal silicates, or mixtures thereof. The mounting mat may include a mixture of more than on type of intumescent material. The intumescent material may comprise a mixture of unexpanded vermiculite and expandable graphite in a relative amount of about 9:1 to about 1:2 vermiculite:graphite, as described in U.S. Pat. No. 5,384,188.

Layers, plies, or sheets of the sol-gel derived fibers may be formed by vacuum casting the slurry. According to this method, the slurry of components is wet laid onto a pervious web. A vacuum is applied to the web to extract the majority of the moisture from the slurry, thereby forming a wet sheet. The wet plies or sheets are then dried, typically in an oven. The sheet may be passed through a set of rollers to compress the sheet prior to drying.

The layers of sol-gel fibers can be cut, such as by die stamping, to form mounting mats of exact shapes and sizes with reproducible tolerances. The mounting mat 20 exhibits suitable handling properties upon densification as by needling or the like, meaning it can be easily handled and is not so brittle as to crumble in one's hand like many other fiber blankets or mats. It can be easily and flexibly fitted or wrapped around the fragile structure 18 or like fragile structure without cracking, and then disposed within the catalytic converter housing 12. Generally, the mounting mat-wrapped fragile structure can be inserted into a housing or the housing can be built or otherwise fabricated around the mounting mat-wrapped fragile structure.

EXPERIMENTAL

The following examples are set forth merely to further illustrate the mounting mat and exhaust gas treatment device. The illustrative examples should not be construed as limiting the mounting mat, exhaust gas treatment device incorporating the mounting mat, or the methods of making the mounting mat or the exhaust gas treatment device in any manner.

Comparative Example 1

Dried and calcined polycrystalline wool fibers having a composition of about 72 alumina and about 28 silica are used to form a sheet. A wet-laid sheet of polycrystalline wool fibers was prepared by mixing the fibers and water to form a slurry and then removing the water through a porous screen with a vacuum. The wet-laid sheet of calcined polycrystalline wool fibers was dried at a temperature of 110° C. The dried sheet of calcined polycrystalline wool fibers was needled by a commercially available needling machine. Upon exposing the sheet to the needling process, the sheet fell apart as the brittle and stiff calcined polycrystalline wool fibers were broken by the force of the needles of the needling machine. The resulting mat disintegrated and therefore possessed no measurable tensile strength.

Example 2

Sol-gel formed polycrystalline wool fibers having a composition of about 72 alumina and about 28 silica are used to form a wet-laid and needled sheet. Sol-gel fibers were dried at 250° C. The sol-gel fibers were subsequently heat treated to stabilize them at a temperature of 590° C. A wet-laid sheet of the heat treated sol-gel fibers was prepared by mixing the fibers and water to form a slurry and then removing the water through a porous screen with a vacuum. The wet sheet of stabilized sol-gel fibers was needled using the same needling machine used in Comparative Example 1. The wet-laid and needled sheet of heat treated sol-gel fibers was dried at a temperature of 110° C. The sheet was further calcined at a temperature of about 1200° C. for 1 hour. The tensile strength of the sheet was measured with by Instron Universal Material Testing. The needled and calcined sheet exhibited a tensile strength suitable for an exhaust gas treatment device mounting mat application.

Example 3

Sol-gel formed polycrystalline wool fibers having a composition of about 72 alumina and about 28 silica are used to form a wet-laid and needled sheet. Sol-gel fibers were dried at 250° C. The sol-gel fibers were subsequently heat treated to stabilize them at a temperature of 570° C. A wet-laid sheet of the heat treated sol-gel fibers was prepared by mixing the fibers and water to form a slurry and then removing the water through a porous screen with a vacuum. The wet sheet of stabilized sol-gel fibers was needled using the same needling machine used in Comparative Example 1. The wet-laid and needled sheet of heat treated sol-gel fibers was dried at a temperature of 110° C. The sheet was further calcined at a temperature of about 1200° C. for 1 hour. The tensile strength of the sheet was measured with by Instron Universal Material Testing. The needled and calcined sheet exhibited a tensile strength suitable for an exhaust gas treatment device mounting mat application.

Example 4

Sol-gel formed polycrystalline wool fibers having a composition of about 72 alumina and about 28 silica are used to form a wet-laid and needled sheet. Sol-gel fibers were heat treated to stabilize the fibers at a temperature of 440° C. A 5 gallon bucket was filled with about 4.5 gallons of water and a mixer was placed in the bucket. The sol-gel derived stabilized polycrystalline fibers were gradually added to the bucket. About 10 weight percent leached Belchem silica fiber was gradually into bucket with the water and stabilized polycrystalline fibers. The slurry of water, stabilized polycrystalline fiber and Belchem silica fiber was mixed for about 2 to about 3 minutes.

A wet-laid sheet of the stabilized polycrystalline and Belchem silica fibers was prepared by continued mixing of the slurry in the Handsheet former and then removing the water through a porous screen with a vacuum. The excess moisture was removed from the sheet using a blotting paper. The wet sheet of stabilized sol-gel fibers was needled using the same needling machine used in Comparative Example 1. The wet-laid and wet-needled sheet of stabilized sol-gel fibers was dried at a temperature of 110° C. The needled sheet was further calcined at a temperature of about 1200° C. for 1 hour.

A MTS (Minneapolis, Minn., USA) mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength suitable for an exhaust gas treatment device mounting mat application.

Example 5

Sol-gel formed polycrystalline wool fibers having a composition of about 72 alumina and about 28 silica are used to form a wet-laid and needled sheet. Sol-gel fibers were heat treated to stabilize the fibers at a temperature of 540° C. A 5 gallon bucket was filled with about 4.5 gallons of water and a mixer was placed in the bucket. The sol-gel derived stabilized polycrystalline fibers were gradually added to the bucket. The slurry of water and stabilized polycrystalline fiber was mixed for about 2 to about 3 minutes.

A wet-laid sheet of the stabilized polycrystalline was prepared by continued mixing of the slurry in the Handsheet former and then removing the water through a porous screen with a vacuum. The excess moisture was removed from the sheet using a blotting paper. The wet sheet of stabilized sol-gel fibers was needled using the same needling machine used in Comparative Example 1. The wet-laid and wet-needled sheet of stabilized sol-gel fibers was dried at a temperature of 110° C. The needled sheet was further calcined at a temperature of about 1200° C. for 1 hour.

A MTS mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength suitable for an exhaust gas treatment device mounting mat application.

Example 6

Sol-gel formed polycrystalline wool fibers having a composition of about 72 alumina and about 28 silica are used to form a wet-laid and needled sheet. Sol-gel fibers were heat treated to stabilize the fibers at a temperature of 540° C. A 5 gallon bucket was filled with about 4.5 gallons of water and a mixer was placed in the bucket. The sol-gel derived stabilized polycrystalline fibers were gradually added to the bucket. About 10 weight percent leached Belchem silica fiber was gradually into bucket with the water and stabilized polycrystalline fibers. The slurry of water, stabilized polycrystalline fiber and Belchem silica fiber was mixed for about 2 to about 3 minutes.

A wet-laid sheet of the stabilized polycrystalline and Belchem silica fibers was prepared by continued mixing of the slurry in the Handsheet former and then removing the water through a porous screen with a vacuum. The excess moisture was removed from the sheet using a blotting paper. The wet sheet of stabilized sol-gel fibers was needled using the same needling machine used in Comparative Example 1. The wet-laid and wet-needled sheet of stabilized sol-gel fibers was dried at a temperature of 110° C. The needled sheet was further calcined at a temperature of about 1200° C. for 1 hour.

A MTS mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength suitable for an exhaust gas treatment device mounting mat application.

Comparative Example C7

Commercially available sol-gel formed polycrystalline wool fibers having a composition of about 72 alumina and about 28 silica are used to form a wet-laid and needled sheet. Sol-gel fibers were heat treated to calcine the fibers at a temperature of 1100° C. for about 30 minutes. A 5 gallon bucket was filled with about 4.5 gallons of water and a mixer was placed in the bucket. The sol-gel derived calclined polycrystalline fibers were gradually added to the bucket. The slurry of water and calcined polycrystalline fiber was mixed for about 2 to about 3 minutes.

A wet-laid sheet of the calcined polycrystalline fibers was prepared by continued mixing of the slurry in the Handsheet former and then removing the water through a porous screen with a vacuum. The excess moisture was removed from the sheet with a blotting paper. The wet calcined sheet of sol-gel fibers was needled using the same needling machine used in Comparative Example 1.

A MTS mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength not suitable for an exhaust gas treatment device mounting mat application.

Comparative Example C8

Commercially available sol-gel formed polycrystalline wool fibers having a composition of about 72 alumina and about 28 silica are used to form a wet-laid and needled sheet. Sol-gel fibers were heat treated to calcined the fibers at a temperature of 1100° C. for about 30 minutes. A 5 gallon bucket was filled with about 4.5 gallons of water and a mixer was placed in the bucket. The sol-gel derived calcined polycrystalline fibers were gradually added to the bucket. About 10 weight percent leached Belchem silica fiber was gradually into bucket with the water and calcined polycrystalline fibers. The slurry of water, calcined polycrystalline fiber and Belchem silica fiber was mixed for about 2 to about 3 minutes.

A wet-laid sheet of the calcined polycrystalline fibers was prepared by continued mixing of the slurry in the Handsheet former and then removing the water through a porous screen with a vacuum. The excess moisture was removed from the sheet with a blotting paper. The wet calcined sheet of sol-gel fibers was needled using the same needling machine used in Comparative Example 1.

A MTS mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength not suitable for an exhaust gas treatment device mounting mat application.

Comparative Example C9

Commercially available sol-gel formed polycrystalline wool fibers having a composition of about 72 alumina and about 28 silica are used to form a wet-laid and needled sheet. Sol-gel fibers were heat treated to calcine the fibers at a temperature of 1100° C. for about 30 minutes. A 5 gallon bucket was filled with about 4.5 gallons of water and a mixer was placed in the bucket. The sol-gel derived calclined polycrystalline fibers were gradually added to the bucket. The slurry of water and calcined polycrystalline fiber was mixed for about 2 to about 3 minutes.

A wet-laid sheet of the calcined polycrystalline fibers was prepared by continued mixing of the slurry in the Handsheet former and then removing the water through a porous screen with a vacuum. The excess moisture was removed from the sheet with a blotting paper. The wet calcined sheet of sol-gel fibers was needled using the same needling machine used in Comparative Example 1. The needled sheet of sol-gel fibers was dried at a temperature of 110° C., and subsequently exposed to a 1200° C. for 1 hour.

A MTS mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength not suitable for an exhaust gas treatment device mounting mat application.

Comparative Example C10

Commercially available sol-gel formed polycrystalline wool fibers having a composition of about 72 alumina and about 28 silica are used to form a wet-laid and needled sheet. Sol-gel fibers were heat treated to calcined the fibers at a temperature of 1100° C. for about 30 minutes. A 5 gallon bucket was filled with about 4.5 gallons of water and a mixer was placed in the bucket. The sol-gel derived calcined polycrystalline fibers were gradually added to the bucket. About 10 weight percent leached Belchem silica fiber was gradually into bucket with the water and calcined polycrystalline fibers. The slurry of water, calcined polycrystalline fiber and Belchem silica fiber was mixed for about 2 to about 3 minutes.

A wet-laid sheet of the calcined polycrystalline fibers was prepared by continued mixing of the slurry in the Handsheet former and then removing the water through a porous screen with a vacuum. The excess moisture was removed from the sheet with a blotting paper. The wet calcined sheet of sol-gel fibers was needled using the same needling machine used in Comparative Example 1. The needled sheet of sol-gel fibers was dried at a temperature of 110° C., and subsequently exposed to a 1200° C. for 1 hour.

A MTS mechanical test machine was used for testing the tensile strength of the mounting mat sample. Test samples of the mounting mat were cut into strips having the dimensions of about 1"×about 6". Three (3) sample mounting mats were tested and the average of the results for the 3 mounting mats is reported in Table 1 below. The needled and calcined sheet exhibited a tensile strength not suitable for an exhaust gas treatment device mounting mat application.

TABLE 1

| Sample | Fiber Treatment | Additional belchem Fiber | Tensile (lbf) |
|---|---|---|---|
| 4 | Stabilized at 440 C. Prior to Needling; Calcined at 1200 C. After Needling | 10% | 1.35 |
| 5 | Stabilized at 540 C. Prior to Needling; Calcined at 1200 C. After Needling | 0% | 1.46 |
| 6 | Stabilized at 540 C. Prior to Needling; Calcined at 1200 C. After Needling | 10% | 1.43 |
| C7 | Calcined at 1100 C. Prior to Needling; No Heat Treatment After Needling | 0% | 0.21 |
| C8 | Calcined at 1100 C. Prior to Needling; No Heat Treatment After Needling | 10% | 0.19 |
| C9 | Calcined at 1100 C. Prior to Needling; Further Heat Treatment at 1200 C. After Needling | 0% | 0.14 |
| C10 | Calcined at 1100 C. Prior to Needling; Further Heat Treatment at 1200 C. After Needling | 10% | 0.22 |

The mounting mats of Examples 4-6 comprising a wet laid sheets of stabilized polycrystalline inorganic fibers that were needled while the mat was still in a wet condition exhibited a significant improvement in tensile properties as compared to the mounting mats of Comparative Examples C7 and C8 that were prepared by needling a sheet of polycrystalline fibers that had been fully calcined at 1100 C prior to the needling operation.

The mounting mats of Examples 4-6 comprising a wet laid sheets of stabilized polycrystalline inorganic fibers that were needled while the mat was still in a wet condition also exhibited a significant improvement in tensile properties as compared to the mounting mats of Comparative Examples C9 and C10 that were prepared by needling a sheet of polycrystalline fibers that had been fully calcined at 1100 C prior to the needling operation and which were subjected to a further calcining operation at 1200 C after the mounting mats were needled.

These mats are advantageous to the catalytic converter and diesel particulate trap industry. The mounting mats can be die cut and are operable as resilient supports in a thin profile, providing case of handling, and in a flexible form, so as to be able to provide a total wrap of the catalyst support structure, if desired, without cracking. Alternatively, the mounting mat may be integrally wrapped about the entire circumference or perimeter of at least a portion of the catalyst support structure. The mounting mat may also be partially wrapped and include an end-seal as currently used in some conventional converter devices, if desired, to prevent gas by-pass.

The mounting mats described above are also useful in a variety of applications such as conventional automotive catalytic converters for, among others, motorcycles and other small engine machines, and automotive preconverters, as well as high temperature spacers, gaskets, and even future generation automotive underbody catalytic converter systems. Generally, they can be used in any application requiring a mat or gasket to exert holding pressure at room temperature and, more importantly, to provide the ability to maintain the holding pressure at elevated temperature, including during thermal cycling.

The mounting mat material may be used as end cone insulation in an exhaust gas treatment device. According to certain embodiments, an end cone for an exhaust gas treatment device is provided. The end cone generally comprises an outer metallic cone, an inner metallic cone and end cone insulation that is disposed within the gap or space between the outer and inner metallic end cones.

According to other embodiments, the end cone may comprise an outer metallic cone and at least one layer of cone insulation that is positioned adjacent to the inner surface of the outer metallic cone. According to these embodiments, the end cone assembly is not provided with an inner metallic cone. Rather, the cone insulation is rigidized in some manner to provide a self-supporting cone structure that is resistant to the high temperature gases flowing through the device.

An exhaust gas treatment device including at least one end cone is provided. The exhaust gas treatment device comprises a housing, a fragile structure positioned within the housing, an inlet and an outlet end cone assemblies for attaching exhaust pipes to the housing, each end cone assembly comprising an inner end cone housing and an outer end cone housing; and end cone insulation comprising heat treated biosoluble fibers and optionally intumescent material positioned between the inner and outer cone housings.

The mounting mats described above can also be used in catalytic converters employed in the chemical industry which are located within exhaust or emission stacks, including those which contain fragile honeycomb type structures that need to be protectively mounted.

While the mounting mat and exhaust gas treatment device have been described in connection with various illustrative embodiments, it is to be understood that other similar embodiments may be used or modifications and additions may be made to the described embodiments for performing the same function disclosed herein without deviating therefrom. The embodiments described above are not necessarily in the alternative, as various embodiments may be combined to provide the desired characteristics. Therefore, the mounting mat and exhaust gas treatment device should not be limited to any single embodiment, but rather construed in breadth and scope in accordance with the recitation of the appended claims.

The invention claimed is:

1. A method for making a mounting mat for an exhaust gas treatment device comprising:

stabilizing a plurality of sol-gel derived inorganic fibers, wherein the stabilizing comprises heating the sol-gel derived inorganic fibers at a temperature lower than 600° C. to render at least a portion of the sol-gel derived fibers insoluble in water;

wet laying a wet layer of said stabilized sol-gel derived inorganic fibers; and needle punching a portion of said sol-gel derived inorganic fibers within the wet layer.

2. The method for making a mounting mat for an exhaust gas treatment device of claim 1, further comprising drying said wet and needle punched layer of stabilized sol-gel derived inorganic fibers.

3. The method for making a mounting mat for an exhaust gas treatment device of claim 1, further comprising calcining the needle punched layer of stabilized sol-gel derived inorganic fibers.

4. The method for making a mounting mat for an exhaust gas treatment device of claim 3, wherein the calcining occurs at a temperature in the range from about 900 to about 1,500° C.

5. The method for making a mounting mat for an exhaust gas treatment device of claim 1, wherein said wet laying comprises preparing a slurry of stabilized sol-gel derived inorganic fibers and a liquid, and removing at least a portion of said liquid from the slurry to form a wet-laid layer of stabilized sol-gel derived inorganic fibers from the slurry.

6. The method for making a mounting mat for an exhaust gas treatment device of claim 5, wherein the sol-gel derived inorganic fibers comprise the fiberization product of about 72 to about 100 weight percent alumina and about 0 to about 28 weight percent silica.

7. The method for making a mounting mat for an exhaust gas treatment device of claim 5, wherein the sol-gel derived inorganic fibers comprise high alumina fibers.

8. The method for making a mounting mat for an exhaust gas treatment device of claim 5, wherein said wet layer comprises a mixture of said sol-gel derived inorganic fibers and different inorganic fibers selected from the group consisting of ceramic fibers, glass fibers, biosoluble fibers, quartz fibers, silica fibers, and mixtures thereof.

9. The method for making a mounting mat for an exhaust gas treatment device of claim 8, wherein the ceramic fibers comprise alumino-silicate fibers comprising the fiberization product of about 45 to about 72 weight percent alumina and about 28 to about 55 weight percent silica.

10. The method for making a mounting mat for an exhaust gas treatment device of claim 8, wherein the biosoluble fibers comprise magnesia-silica fibers comprising the fiberization product of about 65 to about 86 weight percent silica, from about 14 to about 35 weight percent magnesia and about 5 weight percent or less impurities.

11. The method for making a mounting mat for an exhaust gas treatment device of claim 10, wherein the magnesia-silica fibers comprise the fiberization product of about 70 to about 86 weight percent silica, about 14 to about 30 weight percent magnesia and about 5 weight percent or less impurities.

12. The method for making a mounting mat for an exhaust gas treatment device of claim 11, wherein the magnesia-silica fibers comprise the fiberization product of about 70 to about 80 weight percent silica, about 18 to about 27 weight percent magnesia and 0 to 4 weight percent impurities.

13. The method for making a mounting mat for an exhaust gas treatment device of claim 8, wherein the biosoluble fibers comprise calcia-magnesia-silica fibers comprising the fiberization product of about 45 to about 90 weight percent silica, greater than 0 to about 45 weight percent calcia, and greater than 0 to about 35 weight percent magnesia.

14. The method for making a mounting mat for an exhaust gas treatment device of claim 13, wherein the calcia-magnesia-silica fibers comprise the fiberization product of about 60 to about 70 weight percent silica, from about 16 to about 35 weight percent calcia, and from about 4 to about 19 weight percent magnesia.

15. The method for making a mounting mat for an exhaust gas treatment device of claim 14, wherein the calcia-magnesia-silica fibers comprise the fiberization product of about 61 to about 67 weight percent silica, from about 27 to about 33 weight percent calcia, and from about 2 to about 7 weight percent magnesia.

16. The method for making a mounting mat for an exhaust gas treatment device of claim 1, wherein the mounting mat further comprises an intumescent material selected from the group consisting of unexpanded vermiculite, ion exchanged vermiculite, heat treated vermiculite, expandable graphite, hydrobiotite, water-swelling tetrasilicic flourine mica, alkaline metal silicates, or mixtures thereof.

* * * * *